US007216715B2

(12) United States Patent
Reynolds

(10) Patent No.: US 7,216,715 B2
(45) Date of Patent: May 15, 2007

(54) MODULAR, DISTRIBUTED, ROV RETRIEVABLE SUBSEA CONTROL SYSTEM, ASSOCIATED DEEPWATER SUBSEA BLOWOUT PREVENTER STACK CONFIGURATION, AND METHODS OF USE

(75) Inventor: Graeme E. Reynolds, Houston, TX (US)

(73) Assignee: Oceaneering International, Inc., Houston, TX (US)

( * ) Notice: Subject to any disclaimer, the term of this patent is extended or adjusted under 35 U.S.C. 154(b) by 0 days.

(21) Appl. No.: 11/418,573

(22) Filed: May 5, 2006

(65) Prior Publication Data

US 2006/0201683 A1 Sep. 14, 2006

Related U.S. Application Data

(63) Continuation of application No. 11/205,893, filed on Aug. 17, 2005.

(60) Provisional application No. 60/603,190, filed on Aug. 20, 2004.

(51) Int. Cl.
*E21B 29/12* (2006.01)

(52) U.S. Cl. ..... 166/339; 166/373; 166/344; 166/351; 251/1.1

(58) Field of Classification Search ..... 166/341, 166/338, 343, 345, 359, 367, 368, 363, 364, 166/373, 351, 344; 137/236.1; 251/1.1, 251/1.3, 30.01
See application file for complete search history.

(56) References Cited

U.S. PATENT DOCUMENTS 3,319,923 A * 5/1967 Haeber et al. ..... 251/1.3
3,656,549 A * 4/1972 Holbert et al. ..... 166/356
3,865,142 A * 2/1975 Begun et al. ..... 137/635
3,894,560 A * 7/1975 Baugh ..... 137/606
3,921,500 A * 11/1975 Silcox ..... 91/4 R
4,052,703 A * 10/1977 Collins et al. ..... 714/2
4,095,421 A * 6/1978 Silcox ..... 60/398
4,174,000 A * 11/1979 Milberger ..... 166/363
4,378,848 A * 4/1983 Milberger ..... 166/351
4,399,872 A * 8/1983 McConaughy et al. ..... 166/341
4,497,369 A * 2/1985 Hurta et al. ..... 166/368
4,565,349 A * 1/1986 Tomlin ..... 251/29
4,687,179 A * 8/1987 Smith ..... 251/58
5,040,607 A * 8/1991 Cordeiro et al. ..... 166/366
5,398,761 A 3/1995 Reynolds et al.
6,032,742 A 3/2000 Tomlin et al.
6,098,715 A * 8/2000 Seixas et al. ..... 166/347
6,142,233 A * 11/2000 Wilkins ..... 166/339
6,161,618 A * 12/2000 Parks et al. ..... 166/351
6,484,806 B2 11/2002 Childers et al.
6,564,872 B2 * 5/2003 Davey et al. ..... 166/344
6,612,369 B1 * 9/2003 Rocha et al. ..... 166/363
6,622,799 B2 * 9/2003 Dean ..... 166/381
6,907,932 B2 * 6/2005 Reimert ..... 166/341
6,938,695 B2 * 9/2005 Williams ..... 166/341

(Continued)

*Primary Examiner*—Thomas A Beach
(74) *Attorney, Agent, or Firm*—Duane Morris LLP

(57) ABSTRACT

A distributed function control module adapted for use in a modular blowout preventer (BOP) stack for use subsea comprises a housing, adapted to be manipulated by a remotely operated vehicle (ROV) with a stab portion adapted to be received into a BOP stack control module receiver. Control electronics, adapted to control a predetermined function with respect to the BOP stack, are disposed within the housing and connected to one or more controllable devices by a wet mateable connector interface.

44 Claims, 6 Drawing Sheets

U.S. PATENT DOCUMENTS

2001/0003288 A1* 6/2001 Clayton et al. ..... 137/884
2002/0074125 A1 6/2002 Fikes et al.
2002/0100589 A1 8/2002 Childers et al.
2003/0006070 A1 1/2003 Dean

* cited by examiner

MODULAR, DISTRIBUTED, ROV RETRIEVABLE SUBSEA CONTROL SYSTEM, ASSOCIATED DEEPWATER SUBSEA BLOWOUT PREVENTER STACK CONFIGURATION, AND METHODS OF USE

RELATION TO OTHER APPLICATIONS

This application is a continuation of pending U.S. patent application Ser. No. 11/205,893, filed on Aug. 17, 2005, which claims the benefit of U.S. Provisional Application No. 60/603,190, filed on Aug. 20, 2004.

BACKGROUND OF THE INVENTION

The inventions relate to offshore drilling operations and more specifically to a deepwater subsea blowout preventer stack configuration and its control system architecture, system interface, and operational parameters.

When drilling in deepwater from a floating drilling vessel, a blowout preventer stack (BOP Stack) is typically connected to a wellhead, at the sea floor, and a diverter system, which is mounted under the rig sub-structure at the surface via a marine riser system. Although pressure containing components, connectors, structural members, reentry guidance systems, load bearing components, and control systems have been upgraded for the operational requirement, the overall system architecture has remained common for more than two decades.

The BOP Stack is employed to provide a means to control the well during drilling operations and provide a means to both secure and disconnect from the well in the advent of the vessel losing position due to automatic station keeping failure, weather, sea state, or mooring failure.

A conventionally configured BOP Stack is typically arranged in two sections, including an upper section (Lower Marine Riser Package) which provides an interface to a marine riser via a riser adapter located at the top of the package. The riser adapter is secured to a flex-joint which provides angular movement, e.g. of up to ten degrees (10°), to compensate for vessel offset. The flex-joint assembly, in turn, interfaces with a single or dual element hydraulically operated annular type blowout preventer (BOP), which, by means of the radial element design, allows for the stripping of drill pipe or tubulars which are run in and out of the well. Also located in the Lower Marine Riser Package (or upper section) is a hydraulically actuated connector which interfaces with a mandrel, typically located on the top of the BOP Stack lower section. The BOP Stack lower section typically comprises a series of hydraulically operated ram type BOPs connected together via bolted flanges in a vertical plane creating a ram stack section. In turn, the ram stack section interfaces to a hydraulically latched wellhead connector via a bolted flange. The wellhead connector interfaces to the wellhead, which is a mandrel profile integral to the wellhead housing, which is the conduit to the wellbore.

Conduit lines integral to the marine riser provide for hydraulic fluid supply to the BOP Stack Control System and communication with the wellbore annulus via stack mounted gate valves. The stack mounted gate valves are arranged in the ram stack column at various positions allowing circulation through the BOP Stack column depending on which individual ram is closed.

The unitized BOP Stack is controlled by means of a control system containing pilot and directional control valves which are typically arranged in a control module or pod. Pressure regulators are typically included in the control pod to allow for operating pressure increase/decrease for the hydraulic circuits which control the functions on the unitized BOP Stack. These valves, when commanded from the surface, either hydraulically or electro-hydraulically direct pressurized hydraulic fluid to the function selected. Hydraulic fluid is supplied to the BOP Stack via a specific hydraulic conduit line. In turn, the fluid is stored at pressure in stack-mounted accumulators, which supply the function directional control valves contained in redundant (two (2)) control pods mounted on the lower marine riser package or upper section of the BOP Stack.

Currently, most subsea blowout preventer control systems are arranged with "open" circuitry whereby spent fluid from the particular function is vented to the ocean and not returned to the surface.

A hydraulic power unit and accumulator banks installed within the vessel provide a continuous source of replenishment fluid that is delivered to the subsea BOP Stack mounted accumulators via a hydraulic rigid conduit line and stored at pressure. The development and configuration of BOP Stacks and the control interface for ultra deep water applications has in effect remained conventional as to general arrangement and operating parameters.

Recent deepwater development commitments have placed increased demands for well control systems, requiring dramatic increases in the functional capability of subsea BOP Stacks and, in turn, the control system operating methodologies and complexity. These additional operational requirements and complexities have had a serious effect on system reliability, particularly in the control system components and interface.

Although redundancy provisions are provided by the use of two control pods, a single point failure in either control pod or function interface is considered system failure necessitating securing the well and retrieving the lower marine riser package, containing the control pods, or the complete BOP Stack for repair.

Retrieving any portion of the BOP Stack is time consuming creating "lost revenue" and rig "down time" considering the complete marine riser must be pulled and laid down.

Running and retrieving a subsea BOP Stack in deepwater is a significant event with potential for catastrophic failure and injury risk for personnel involved in the operation.

In addition, vessel configuration, size, capacity, and handling equipment has been dramatically increased to handle, store, and maintain the larger more complex subsea BOP Stacks and equipment. The configuration and pressure rating of the overall BOP Stack requires substantial structural members be incorporated into the assembly design to alleviate bending moment potential, particularly in the choke and kill stab interface area between the Lower Marine Riser Package and BOP Stack interface. These stab interfaces may see in excess of two hundred and seventy five thousand (275,000') ft/lbs. separating forces, again requiring substantial section modulus in the structural assemblies, which support these components.

Further, a lower marine riser package apron or support assembly size has increased to accommodate the contemporary electro-hydraulic control pods and electronic modules necessary to control and acquire data from an overall Unitized BOP Stack assembly.

Substantial increases in the overall weight and size of high pressure BOP Stacks has created problems for drilling contractors who have a high percentage of existing vessels, which will not accommodate these larger stacks without substantial modifications and considerable expense. In most cases, the larger, heavier and more complex units are requiring by operators for "deep water" applications and reduce the potential for negotiating a contract for the particular rig without this equipment.

BRIEF DESCRIPTION OF THE DRAWINGS

The various drawings supplied herein are representative of one or more embodiments of the present inventions.

DETAILED DESCRIPTION OF EXEMPLARY EMBODIMENTS OF THE INVENTIONS

Figure 1:
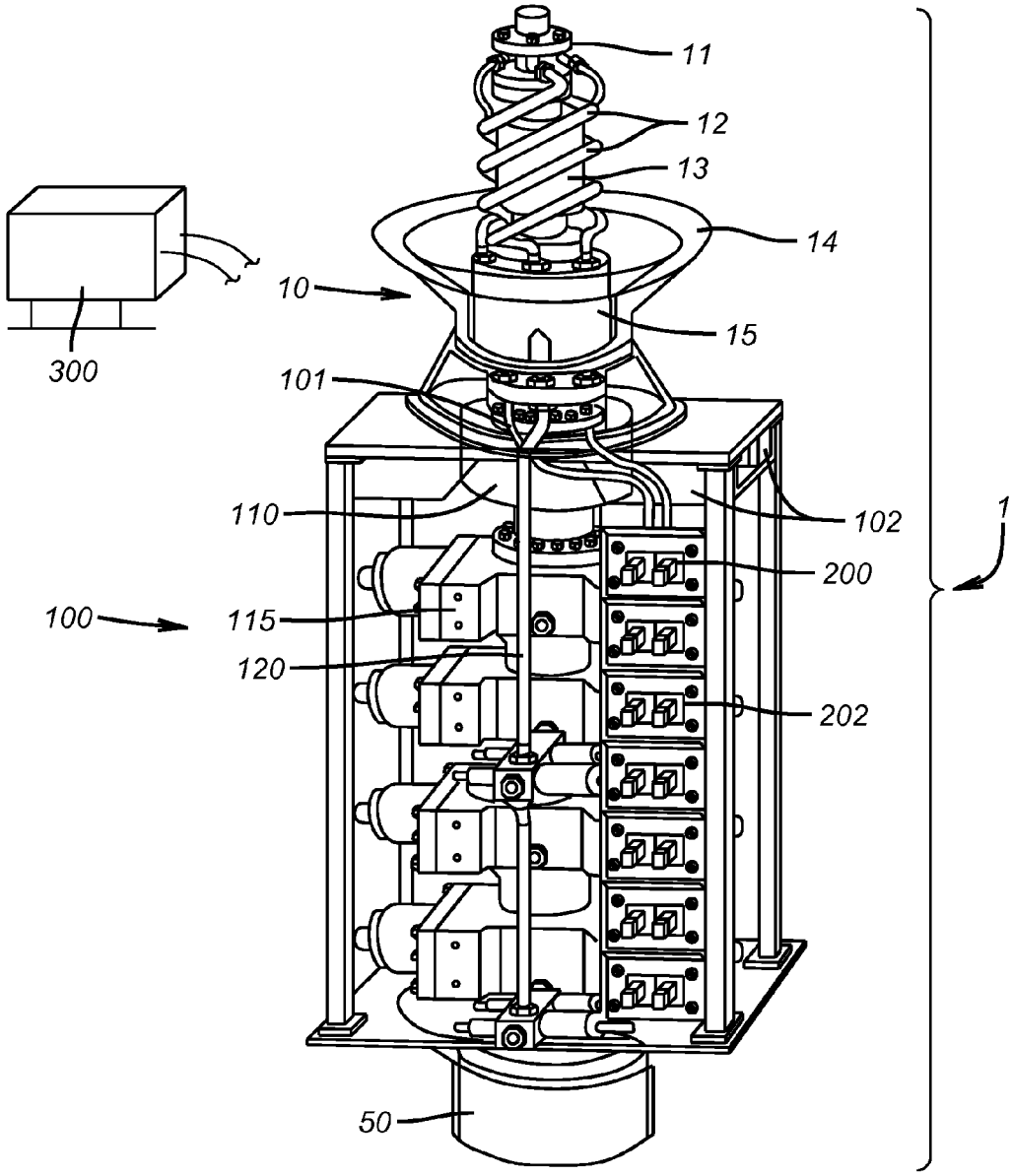
FIG. 1 is a view in partial perspective of a subsea BOP Stack comprising a riser connector, a BOP assembly, and a modular retrievable element control system.

Referring now to FIG. 1, the present inventions comprise elements that, when assembled and unitized, form a reconfigured subsea Blowout Preventer Stack (BOP Stack) 1 including modular retrievable element control system 200. Variations of the architecture and components of modular retrievable element control system 200 may be utilized subsea, e.g. in production tree, production riser, and subsea manifold control interface applications.

In a preferred embodiment, BOP Stack 1 comprises riser connector 10, BOP assembly 100, and wellhead-connector 50.

BOP assembly 100 includes control modules 200 that, in a preferred embodiment, are arranged in a vertical array and positioned adjacent to the particular function each control module 200 controls, such as hydraulic functions. Composition of control module 200 sections preferably include materials that are compatible on both the galvanic and galling scales and be suitable for long term immersion in salt water.

BOP assembly 100 is configured to accept and allow the use of distributed functional control modules 200 which are retrievable using ROV 300. The use of this modular distributed control system architecture in subsea BOP Stack applications allows for the re-configuration of existing BOP stack arrangement designs to reduce weight and complexity in the integration and unitization of the elements required to form the overall BOP Stack 1.

BOP assembly 100 may be unitized and may comprise elements such as a hydraulic connector to interface to the subsea wellhead, one or more blowout preventers 115 (e.g. ram type blowout preventers), annular 110 or spherical type blowout preventers, a plurality of hydraulic connectors to interface to a marine riser (not shown in the figures) and hydraulically operated gate type valves for isolation and access for choke and kill functions.

Riser connector 10 comprises riser adapter 11, guidelineless reentry assembly 14, and multi-bore connector 15. Flex joint 13 is disposed intermediate riser adapter 11 and multibore connector 15. One or more flex loops 12 may be present and in fluid communication with ports on riser adapter 11. Multi-bore connector 15 provides an interface to BOP assembly 100.

BOP assembly 100 may be further adapted to receive one or more control modules 200 into docking stations 202 as well as other modules, e.g. annular preventer 110, RAM preventer 115, blowout preventers (not specifically shown), connectors (not specifically shown), "Fail Safe" gate valves (not specifically shown), sub system interface values (not specifically shown), or the like, or combinations thereof. One or more lines 120, e.g. kill and/or choke lines, may be present as well as various control pathways such as hydraulic conduit 101 and/or MUX cables (e.g. cables 26 in FIG. 2).

Hang-off beams 102 may be provided to allow for support of BOP assembly 100 during certain operations, e.g. in a moon pool area such as for staging and/or testing prior to running.

Figure 2:
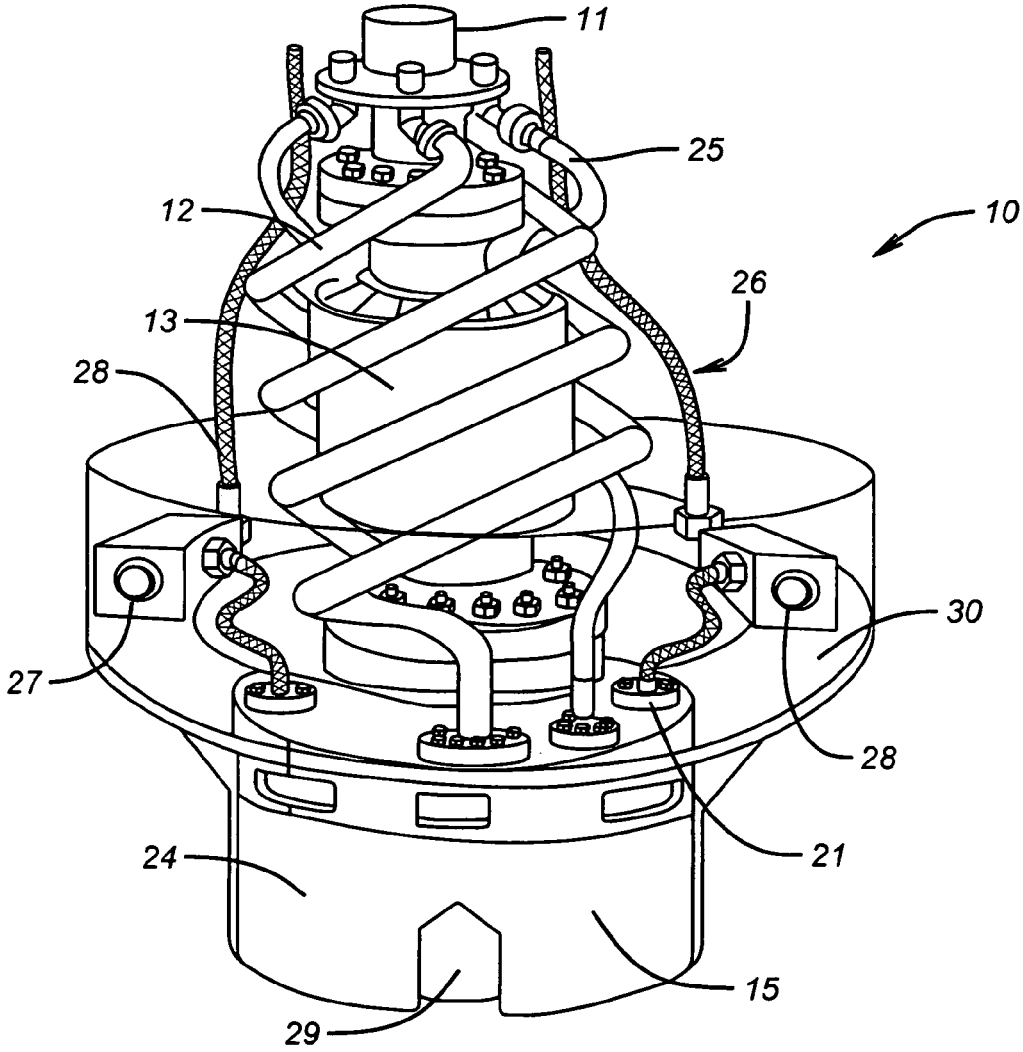
FIG. 2 is a view in partial perspective of a riser connector.

Referring now to FIG. 2, riser connector 10 is typically adapted to provide a connector, such as riser adapter 11, to interface with a marine riser (not shown in the figures). In a preferred embodiment, riser connector 10 comprises one or more MUX cables 26 and hydraulic conduit hoses 25. Riser connector 10 may also incorporate integral connection receptacles for choke/kill, hydraulic, electric, and boost line conduit interfaces. In a preferred embodiment, riser connector 10 is configured with connector 15 as a multi-bore connector rather than single bore connector, although either configuration may be used. This allows for riser connector 10 to absorb loading and separating forces as well as bending moments within its body where substantial section modulus exists. Further, it decreases the need for a substantial fabricated structure to alleviate the potential for separation of a line holding a high pressure, e.g. line 120 (FIG. 1).

In a preferred embodiment, one or more subsea wet mateable connectors 21 are also integrated into riser connector 10 for interfacing with BOP assembly 100 (FIG. 1). This interface may be used to supply power and/or communications to control modules 200 (FIG. 1) located on BOP assembly 100. In a preferred embodiment, the marine riser and its interfaces, such as choke/kill, hydraulic, electric, and boost, may be disconnected or reconnected in one operation from riser connector 10.

In certain embodiments, riser connector 10 may also include riser connector control module 28 which comprises one or more junction boxes and subsea electronics module which may be integral with junction box 27. Using riser connector control module 28 may allow control of riser connector 10 and lower marine riser package functions independent of the BOP stack in the event the marine riser must be disconnected from BOP stack 100 (FIG. 1) and pulled back to the surface.

In a preferred embodiment, subsea electronics module 27 may provide for connections such as electrical connections and may be equipped with connector receptacles for interfacing to ROV devices, e.g. ROV retrievable control modules 200 (FIG. 1) such as to facilitate control of riser connector functions.

In a preferred embodiment, subsea electronics module 27 provides one or more interfaces from main multiplex cables 26 to a lower marine riser package which contains multibore riser connector 15. Wet make/break electrical connectors which may be present, e.g. 21, may be integral to riser connector 15, e.g. via pressure balanced, oil-filled cables.

Apron plate 30, which is of sufficient area to provide for mounting of junction boxes 27, may be present to provide a transition from main multiplex control cable connectors to the wet mateable assemblies located in multi-bore connector 15. Power and other signals to riser connector control module 28 may be effected via an oil filled pressure compensated cable assembly (not shown) that is connected to electrical junction boxes 27 mounted on apron plate 30. In a preferred embodiment, two junction boxes 27 are provided for redundancy and each may be distinguished from the other, e.g. labeled or provided with different colors. Apron plate 30 may be attached to guideline-less reentry funnel 16 (FIG. 3).

In a preferred embodiment, riser connector 10 includes flex joint 13 and one or more flex loops 12, e.g. to allow for angular movement to compensate for vessel offset. The upper flange adapter or flex-joint top connection typically interfaces to a flange of riser adapter 11 containing kick-out flanged assemblies for connection of lines 120 (FIG. 1) interfacing with the marine riser, e.g. formed hard pipe flow-loops that interface choke and kill line 120 to the main marine riser.

Figure 3:
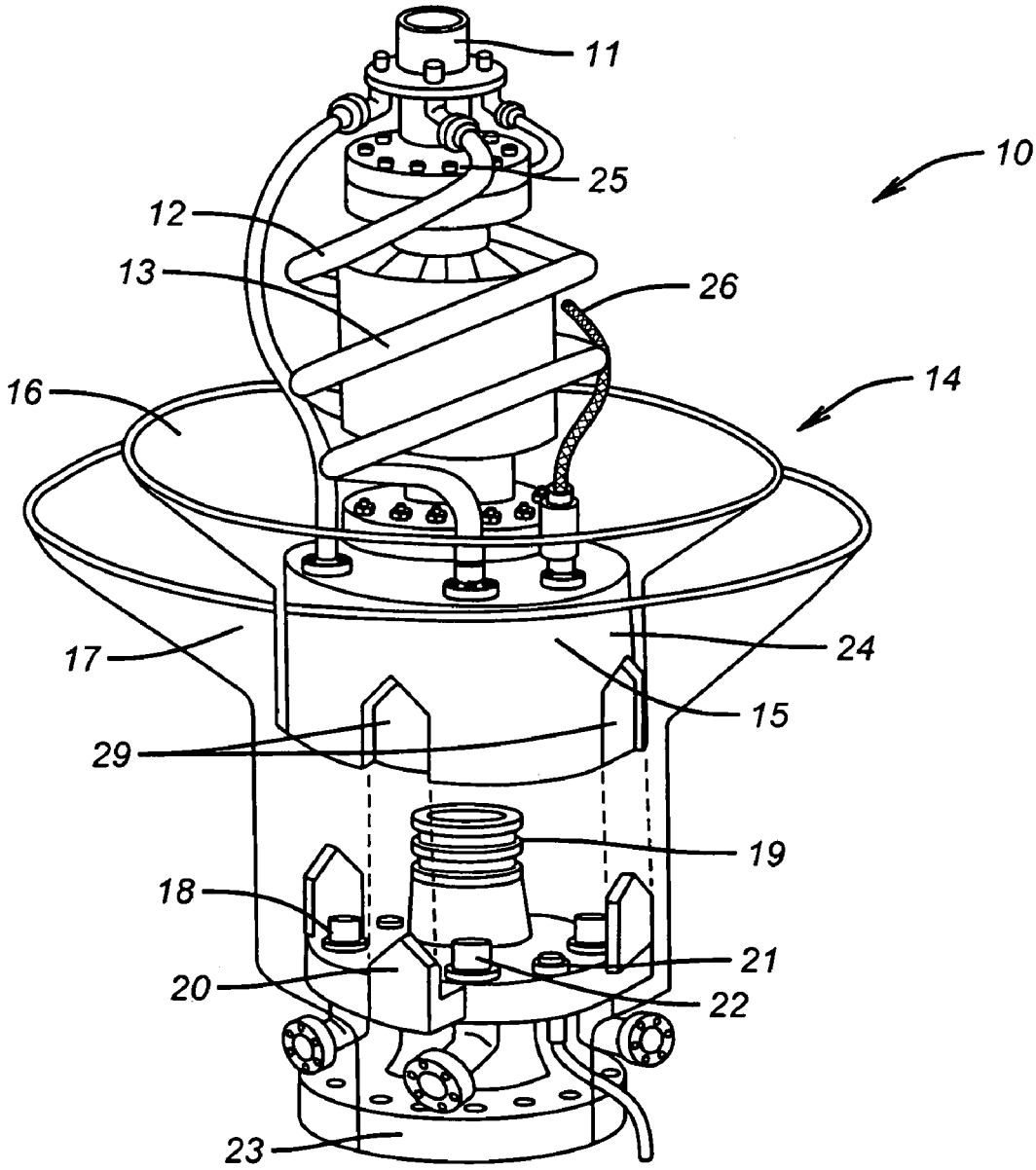
FIG. 3 is a view in partial perspective of a riser connector.

Referring now to FIG. 3, riser connector 10 interfaces with BOP assembly 100 (FIG. 1) using guideline-less receiver assembly 24 and connector mandrel 19. Connector mandrel 19 is typically connected to BOP assembly 100 through riser connector mandrel flange 23 which may be further adapted to provide mounting for choke/kill, hydraulic, MUX cable, boost, electric connectors and stabs, and the like, or a combination thereof.

In a preferred embodiment, riser connector mandrel flange 23 is of the API ring-groove type and interfaces with a matching flange which forms the lower connection of flex-joint assembly 13 or additional elements, e.g. annular blowout preventers which may be mounted on lower marine riser package.

Guideline-less receiver assembly 24 comprises guideline-less reentry funnel 16 and guideline-less reentry receiver 17. Multi-bore connector 15 may be arranged to reside in guideline-less reentry funnel 16 and guideline-less reentry receiver 17 may be attached to the top of BOP assembly 100 (FIG. 1). In a preferred embodiment, guideline-less reentry funnel 16 is configured with a funnel portion that interfaces with a corresponding funnel portion of guideline-less reentry receiver 17.

In further configurations, orientation dogs 20 and corresponding orientation slots 29 may be used to align riser connector 10 with respect to BOP assembly 100 (FIG. 1). This alignment system provides correct orientation of multi-bore connector 15 and its integral peripheral receptacles with corresponding receptacles of BOP assembly 100, e.g. hydraulic stab 18 and/or choke stab 22, during reentry operations.

The connector upper flange of multi-bore connector 15 may be of an API ring groove type and interface with a matching flange which forms a lower connection of flex joint 13.

In a preferred embodiment, the bottom or lower flex loop connection 12 interfaces to multi-bore connector 15, e.g. a studded ring groove connection, via an API flange.

Figure 4:
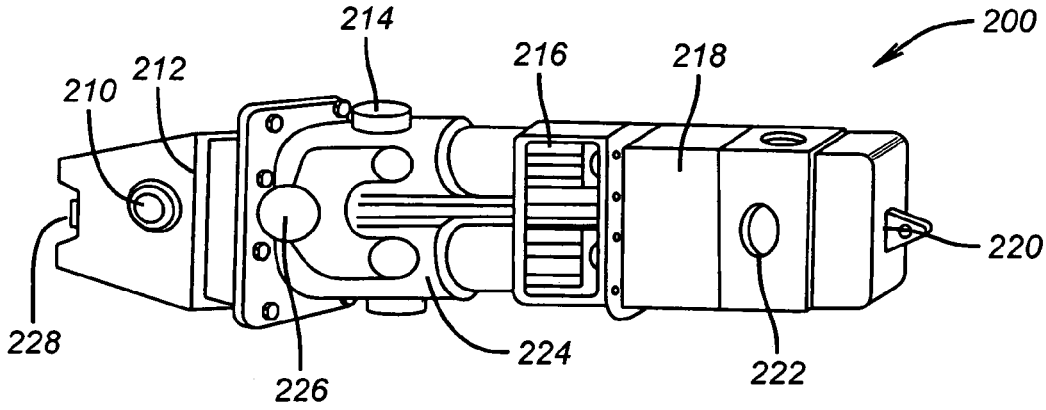
FIG. 4 is a view in partial perspective of a control module.

Referring to FIG. 4, control module 200 includes electronics housing 220 connected to compensator housing 222 which is in communication with or otherwise connected to pressure compensated solenoid housing 218. Pilot valve 216 is located between pressure compensated housing 218 and sub plate mounted (SPM) valve 224. In certain embodiments, pilot valve 216 is adapted to interface with and actuate a predetermined function of SPM valve 224, e.g. via hydraulic activation.

Hydraulic fluid is typically supplied to control module 200 via supply manifold 226. Control module 200 communicates with BOP assembly 100 (FIG. 1) through electrical cable 232 (FIG. 5) in communication with wet mateable connector 228.

Control module 200 is connected to BOP assembly 100 (FIG. 1) via stab 212 that includes a hydraulic seal 210. In a preferred embodiment, hydraulic seal 210 comprises a molded elastomer with an integral reinforcing ring element. Hydraulic seal 210 may be retained in stab 212 via tapered seal retainers which are screw cut to match a female thread profile machined into the stab port interface.

In an embodiment, hydraulic seals 210, also called packer seals, mount into stab 212 and are positioned and retained in a machined counterbore which is common to the hydraulic porting through the body of stab 212. When mated, the stab internal ports containing packer seals 210 align and interface with the matching ports contained in female receptacle 270 (FIG. 7) that are machined on the outside to accept flanged subsea connections. These flanged subsea connections may be retained by SAE split flanges and fasteners and may be provided with weld sockets for pipe, screw cut for tubing connectors, or various hose connectors (i.e., JIC, SAE, or NPT) terminating methods.

In preferred embodiments, wet mateable connector 228 comprises conductors or pins to supply power, signals, or both to electronics (not shown) within control module 200. In addition, a fiber optic conductor connection interface (not shown) may be included for signal command or data acquisition requirements depending on the functional application of the particular module assignment.

SPM valve 224 may further include vent port 214. SPM valve 224 (FIG. 4) typically includes a flanged, ported body cap or top member which contains an actuating piston and one or more integral pilot valves 216. Pilot valve 216 may be solenoid actuated and may be a pressure compensated, linear shear-seal type arranged as a three-way, two position, normally closed, spring return pressure compensated with a five thousand p.s.i. working pressure (WP).

Supply manifold 226 porting and arrangement may vary for valve operation in normally open or normally closed modes. Hydraulic fluid is supplied to pilot valves 216 through a dedicated port through the stab 212. Pressure regulators integral to the supply manifold 226 are provided for supply to function circuits requiring reduced or regulated pressures.

Pilot valves 216 interface with solenoid actuators that are contained in pressure compensated solenoid housing 218. Pressure compensated solenoid housing 218 is preferably filled with di-electric fluid providing a secondary environmental protection barrier.

Figure 5:
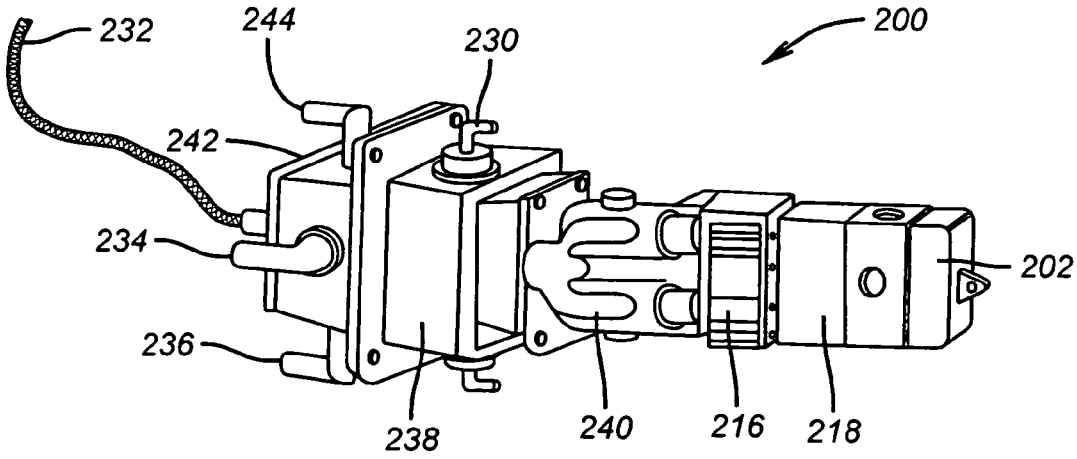
FIG. 5 is a view in partial perspective of a control module mated to a receiver.

Referring to FIG. 5, control module 200 is typically inserted into receiver 238 and may be released by actuating a hydraulic lock dog release 230. Receiver 238 is part of BOP assembly 100 and may be integral to a mounting plate which is permanently mounted to a BOP assembly frame.

SPM valve 224 (FIG. 4) on control module 200 may comprise one or more SPM directional control valves 240 whose manifold pockets may be investment cast from stainless steel with the porting arranged for supply, outlet, and vent functions of three-way, two position, piloted SPM directional control valves 240.

Modern manufacturing techniques, such as investment casting, may be employed for components such as the SPM valve 240, SPM valve 224, and supply manifold 226 providing substantial weight reduction and machining operations.

Figure 6:
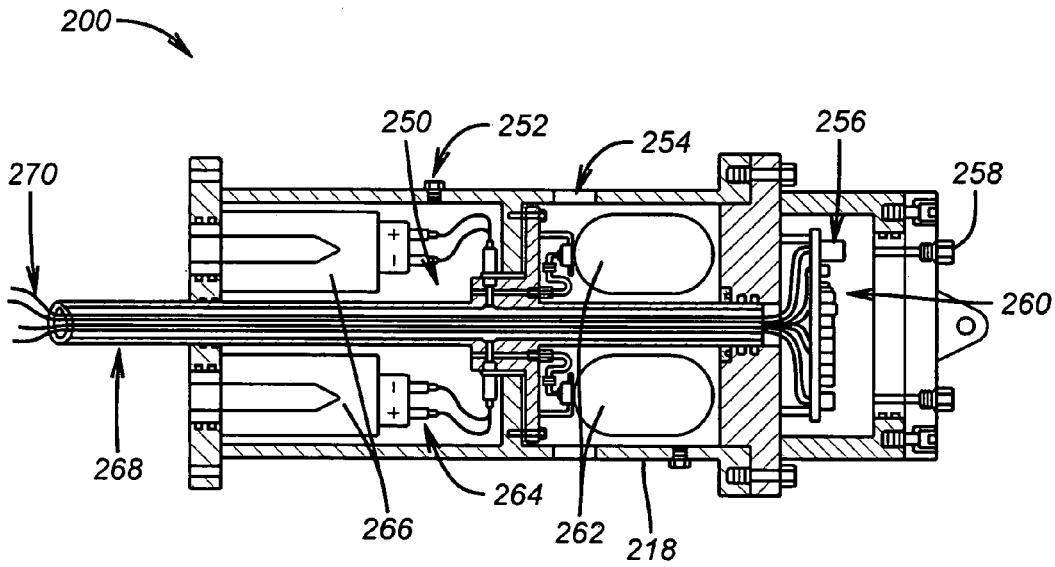
FIG. 6 is a view in partial perspective cutaway of a control module.

Referring to FIG. 6, retrievable control modules 200 include atmosphere chamber 260 containing electronics control input/output (I/O) modules, such as an electronic board 256, and one or more power supplies. In a preferred embodiment, atmosphere chamber 260 is maintained at one atmosphere. In currently preferred embodiments, control module 200 further includes one or more pressure compensating bladders 262, pilot valve actuating solenoids 266, pilot valves 216 (FIG. 4), and poppet valve type SPM valves 240 (FIG. 5) which are piloted from solenoid operated pilot valves 216.

Pressure compensating bladder 262 is contained within pressure compensated solenoid housing 218 to aid in equalizing the housing internal pressure, e.g. with seawater head pressure. An open seawater port 254 may be provided and a relief valve (not shown), e.g. a ten p.s.i. relief valve, may be contained within pressure compensated solenoid housing 218 to limit pressure build up inside pressure compensated solenoid housing 218, allowing equalization of the compensator bladder 262 volume against pressure compensated solenoid housing 218 volume, including a pressure compensated chamber 250. Pressure compensated chamber 250 may be accessed through an oil fill port 252.

A mandrel, e.g. conduit 268, may be disposed more or less centrally through pressure compensated solenoid housing 218 to provide a conduit, at preferably one atmosphere, for electrical/fiber optic conductors from a wet make/break connector half located in stab 212 (FIG. 4). In addition, the internal profile of mandrel 268 may be machined with a counterbore shoulder that is drilled with preparations to accept molded epoxy filled, male connectors for an electrical wiring attachment. In turn, the wiring attachment may terminate at corresponding male connectors at solenoids 266, e.g. via boot seals and/or locking sleeves 264.

Pressure compensated solenoid housing 218 interfaces with atmosphere chamber 260 containing the electronics module. In an embodiment, atmosphere chamber 260 mates to pressure compensated solenoid housing 218 via a bolted flange, which is machined with an upset mandrel containing redundant radial seals. In addition, the internal wire/fiber optic conduit, e.g. conduit 268, mates to an internal counterbore profile via a matching male mandrel also containing redundant radial a-ring seals. Atmosphere chamber 260 may further be equipped with flanged top providing access to the electronics chassis, wiring harness, and pigtail wiring connection. In embodiments, the flanged top is also provided with an upset mandrel containing redundant O-ring seals which interface to the top of atmosphere chamber 260.

In a preferred embodiment, all seal interfaces are machined with test ports to provide a means to test the internal and external O-ring seals to ensure integrity prior to module installation. In addition, housing 260 is typically equipped with "charge" and "vent" ports 258 for purging housing 260, such as with dry nitrogen, providing further environmental protection for the electronics components. Each port 258 may further be equipped with a shut-off valve and secondary seal plug.

In deep subsea use, electrical/electronic interface integrity may be assured by the environmental protection of electrical or fiber optic conductors using a stainless steel conduit spool equipped with redundant seal sub type interface, or the like.

Figure 7:
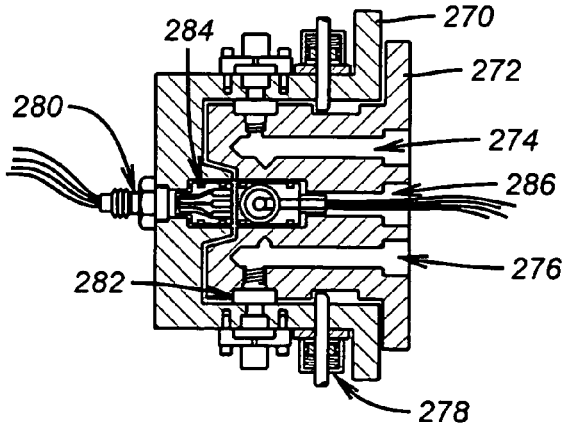
FIG. 7 is a view in partial perspective of an interface between a stab of control module and receiver on a BOP assembly.
Figure 8:
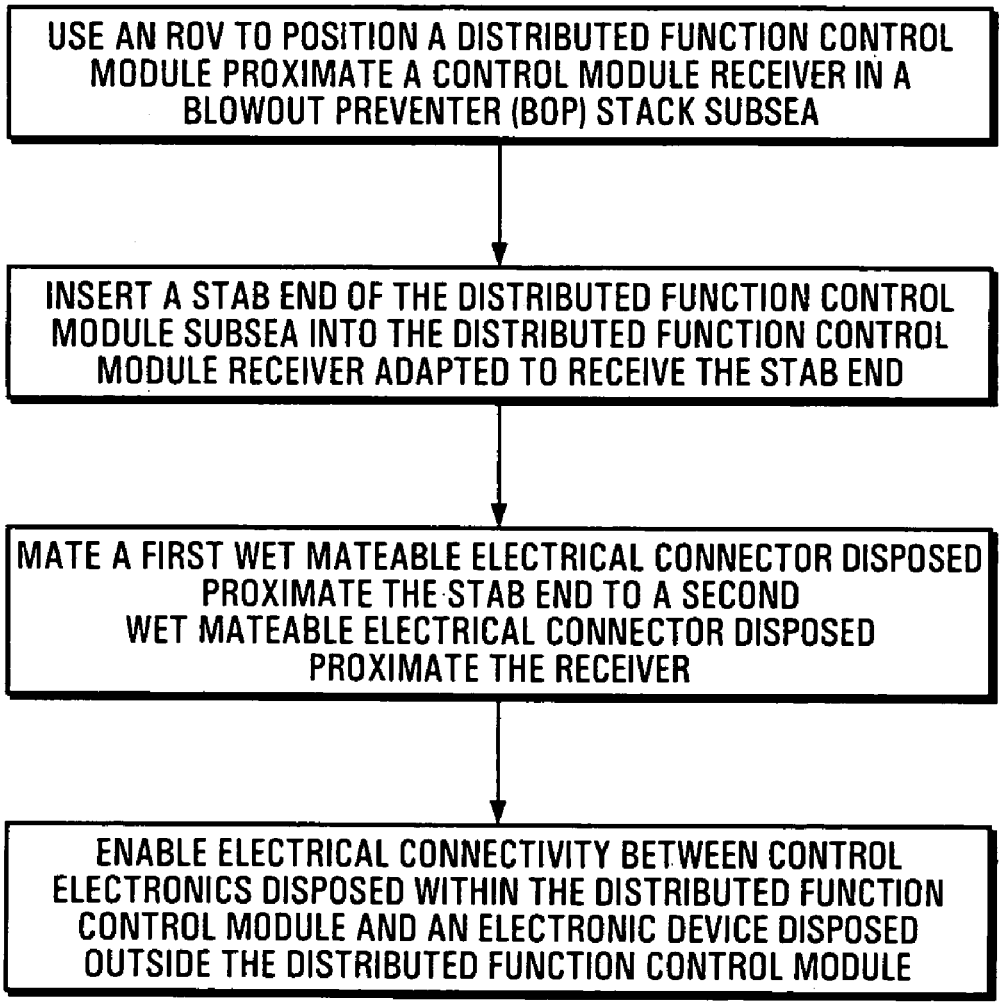
FIG. 8 is a flowchart of an exemplary method of use.

FIG. 7 illustrates a preferred embodiment of the interface between stab 212 (FIG. 4) of control module 200 (FIG. 4) and receiver 238 (FIG. 5) on BOP assembly 100 (FIG. 1). Stab 212 includes male stab 272 that correspond to female receptacle 270 on receiver 238. Female receptacles 270 may contain ports for hydraulic supply 234, 236, 242, 244 (FIG. 5), which provide input and outlets to an assigned blowout preventer stack. Connector body through-bores for female receptacle 270 are machined with preparations to accept poly-pack type radial seal assemblies to seal on male stabs 272.

In a preferred embodiment, the base of male stab 272 is machined with a counterbore profile to accept the male half of the connector insert containing male pins. The counterbore is recessed deep enough to allow the insert to be set back in the stab body providing protection for the individual pins and alleviating the potential for damage during handling.

A corresponding male mandrel profile is machined into the female receptacle base to accept the female half of a connector pair. Both the male mandrel in female receptacle 270 and female counterbore in the male stab 272 are machined with matching tapers, which provide a centering function and positive alignment for the male/female connector halves when stab 272 enters female receptacle 270. In addition, this centering/alignment method further assures correct hydraulic port, equal packer seal alignment, squeeze and loading when male stab 272 is mated in female receptacle 270.

The connection between male stab 272 and female receptacle 270 is maintained by a hydraulic latch 278, and communication is achieved through a wet mateable connector assembly 284, which is preferably of the wet make/break type. Hydraulic communication between male stab 272 and female receptacle 270 is maintained through packer seal assemblies 282.

Male stab 272 interfaces with SPM valve 240 (FIG. 5) through supply channel 274 or function channel 276 which contain redundant O-ring seals with back-up rings. The seal subs locate the manifold element to the stab body via counterbores in each member. Conduit 268 may interface with receiver 238 through conduit mandrel 286.

Additionally, fitting 280 may be present to terminate a cable at receptacle 270. For example, fitting 280 may be an SAE.-to-J.I.C. adapter fitting to terminate a pressure balanced, oil filled cable at receptacle 270.

In the operation of a preferred embodiment, distributed function control module 200 (FIG. 1) may be installed subsea by using ROV 300 to position distributed function control module 200 proximate control module receiver 238 (FIG. 5) in BOP stack 100 (FIG. 1) installed subsea. Once positioned, ROV 300 inserts stab end 272 (FIG. 7) of distributed function control module 200 into distributed function control module receiver 238 which is adapted to receive stab end 272. At a predetermined time, as the insertion occurs, first wet mateable electrical connector 228 (FIG. 5) disposed proximate stab end 272 is mated to second wet mateable electrical connector 228 (FIG. 5) disposed proximate receiver 270 (FIG. 7). Once mated, electrical connectivity between control electronics 256 (FIG. 7) disposed within distributed function control module 200 is enabled between control electronics 256 and an electronic device disposed outside distributed function control module 200.

As the need arises, e.g. for maintenance or repair, ROV 300 may be positioned proximate end 220 (FIG. 5) of the inserted distributed function control module 200 (FIG. 1) distal from stab end 272 (FIG. 7) and distributed function control module 200 disengaged from receiver 270 (FIG. 7), i.e. by withdrawing distributed function control module 200 from receiver 270.

The foregoing disclosure and description of the inventions are illustrative and explanatory. Various changes in the size, shape, and materials, as well as in the details of the illustrative construction and/or a illustrative method may be made without departing from the spirit of the invention.

I claim:

1. A subsea blowout preventer stack control system, comprising:

a. a subsea blowout preventer stack assembly further comprising a plurality of female receiver receptacles, the female receiver receptacles each further comprising a hydraulic supply input port and an outlet port in fluid communication with a predetermined blowout preventer stack operator function port; and b. a plurality of retrievable functional control modules adapted to be maneuevered by a remotely operated vehicle (ROV) and each further adapted to mate with the female receiver receptacle, a predetermined number of the plurality of functional control modules are arranged in a vertical array.

2. The subsea blowout preventer stack control system of claim 1, wherein each of the plurality of functional control modules is positioned adjacent to a predetermined device to be controlled by the functional control module.

3. The subsea blowout preventer stack control system of claim 2, wherein the predetermined function comprises at least one of (i) annular type blowout preventers functions, (ii) ram type blowout preventer functions, (iii) connection functions, (iv) "fail safe" gate valve functions, or (v) sub system interface value functions.

4. The subsea blowout preventer stack control system of claim 1, wherein each of the plurality of functional control modules interfaces with a respective female receiver receptacle port.

5. The subsea blowout preventer stack control system of claim 4, further comprising a static mounted female receiver receptacle base adapted to receive a functional control module, the static mounted female receiver receptacle base further comprising a "wet" make/break type electrical connector portion adapted to functionally mate to a complementary connector portion integrated into a matching male stab portion of the retrievable functional control module.

6. The subsea blowout preventer stack control system of claim 5, wherein the electrical connector portion further comprises a fiber optic conductor connection interface adapted to provide at least one of (i) a signal command or (ii) data acquisition pathways.

7. The subsea blowout preventer stack control system of claim 5, wherein:

a. the retrievable module further comprises an electronics module portion; and b. the electrical connector portion further comprises a predetermined number of conductors adapted to supply either power or a data signal to the electronics module portion of the retrievable module.

8. The subsea blowout preventer stack control system of claim 7, wherein a corresponding male mandrel profile is machined into the static female receptacle base to accept a female portion complementary to the electrical connector portion.

9. The subsea blowout preventer stack control system of claim 8, wherein:

a. both the male mandrel in the female receptacle and a female counterbore in the male stab are machined with matching tapers, adapted to provide a centering function and positive alignment for the male/female connector halves when the stab enters the female receptacle; and b. the male mandrel in the female receptacle and the female counterbore in the male stab further assure correct hydraulic port, equal packer seal alignment, squeeze and loading when the male stab is mated in the female receptacle.

10. The subsea blowout preventer stack control system of claim 1, wherein the retrievable functional control module further comprises:

a. an atmosphere chamber adapted to maintain a predetermined pressure within the atmosphere chamber;

b. an electronics control Input/Output (I/O) module disposed within the atmosphere chamber;

c. a power supply disposed within the atmosphere chamber;

d. a pressure compensated housing disposed proximate the atmosphere chamber, the pressure compensated housing comprising a pressure compensating bladder disposed within the pressure compensated housing;

e. a pilot valve actuating solenoid disposed within the pressure compensated housing;

f. a hydraulic section disposed proximate to the pressure compensated housing;

g. a pilot valve disposed within the hydraulic section, the pilot valve in communication with and operated by the pilot valve actuating solenoid;

h. a function sub plate mounted valve (SPM), in communication with and piloted from the pilot valve; and i. a male stab assembly adapted to interface with a static mounted female receiver receptacle comprising a hydraulic port and a receiver wet make/break electrical connector portion, the male stab assembly further comprising:

i. an interface packer type hydraulic seal; and ii. a stab wet make/break connector half adapted to mate with the receiver wet make/break electrical connector portion and operatively in communication with the electronics control Input/Output (I/O) module.

11. The subsea blowout preventer stack control system of claim 10, wherein the module sections comprise a material which is suitable for long term immersion in salt water.

12. The subsea blowout preventer stack control system of claim 11, wherein the material comprises a plurality of materials which are suitable for long term immersion in salt water and are compatible on at least one of (i) a galvanic scale and (ii) a galling scale.

13. The subsea blowout preventer stack control system of claim 10, wherein the predetermined pressure within the atmosphere chamber is substantially one atmosphere.

14. The subsea blowout preventer stack control system of claim 10, further comprising a central mandrel disposed through the pressure compensated housing, the central mandrel adapted to provide a one atmosphere conduit for conductors from the male wet make/break connector portion.

15. The subsea blowout preventer stack control system of claim 14, further comprising an electrical pigtail terminated at a corresponding male connector at the pilot valve solenoid via at least one of (i) a boot seal or (ii) a locking sleeve.

16. The subsea blowout preventer stack control system of claim 15, wherein the central mandrel's internal profile comprises a counterbore shoulder adapted to receive a molded epoxy filled, male connector for the solenoid electrical conductor pigtail attachment.

17. The subsea blowout preventer stack control system of claim 10, wherein the pressure compensated housing is in fluid communication with the atmosphere chamber.

18. The subsea blowout preventer stack control system of claim 10, wherein the electronics control I/O comprises at least one of (i) a wiring termination or (ii) a fiber optic termination.

19. The subsea blowout preventer stack control system of claim 18, further comprising an internal wire/fiber optic conduit mandrel adapted to mate with an internal counterbore profile via a matching male mandrel the further comprises redundant radial a-ring seals.

20. The subsea blowout preventer stack control system of claim 10, wherein:

a. the atmosphere chamber further comprises a bolted flange, the bolted flange machined with an upset mandrel containing redundant radial seals; and b. the pressure compensated housing further comprises a bolted flange adapted to mate to the atmosphere chamber.

21. The subsea blowout preventer stack control system of claim 10, wherein the atmosphere chamber further comprises a flanged top adapted to provide access to an electronics chassis, a wiring harness, and a pigtail, the flanged top further comprising an upset mandrel, the upset mandrel comprising redundant O-ring seal interfaces adapted to interface to the atmosphere chamber top.

22. The subsea blowout preventer stack control system of claim 21, wherein the O-ring seal interfaces are machined with a test port adapted to allow testing between internal and external O-ring seals to ensure integrity prior to module installation.

23. The subsea blowout preventer stack control system of claim 10, wherein the atmosphere housing further comprises:

a. a charge port comprising a shut-off valve and secondary seal plug; and b. a vent port comprising a shut-off valve and secondary seal plug;

c. wherein the charge port and the vent port are adapted to allow purging the atmosphere chamber with a gas.

24. The subsea blowout preventer stack control system of claim 10, further comprising a SPM valve manifold assembly in communication with the SPM valve wherein the SPM valve manifold assembly further comprises a flanged ported top member further comprising an SPM actuating piston and integral SPM pilot valve assembly.

25. The subsea blowout preventer stack control system of claim 24, wherein the SPM pilot valve assembly comprises a solenoid actuated, pressure compensated, linear shear-seal type arranged as a three (3)-way, two (2) position, normally closed, spring return, pressure compensated, five thousand (5,000) psi Working Pressure (WP).

26. The subsea blowout preventer stack control system of claim 24, wherein the SPM pilot valve assembly is in communication with the pilot valve actuating solenoid.

27. The subsea blowout preventer stack control system of claim 10, wherein the pressure compensated housing comprises:

a. a dielectric fluid; and b. a circular elastomer bladder adapted to equalize internal pressure within the pressure compensated housing with seawater head pressure.

28. The subsea blowout preventer stack control system of claim 10, wherein the pressure compensated housing further comprises a relief valve adapted to limit pressure build up inside the pressure compensated housing and allow equalization of the compensator bladder volume against housing volume.

29. The subsea blowout preventer stack control system of claim 10, further comprising a stainless steel conduit spool quipped with redundant seal sub type interfaces between the male stab portion and the one (1) atmosphere electronics-housing portion adapted to protect electrical or fiber optic conductors that are integral with the male connector portion.

30. The subsea blowout preventer stack control system of claim 5, wherein the male stab further comprises a base that is machined with a counterbore profile to accept the male portion of a connector insert containing male pins.

31. The subsea blowout preventer stack control system of claim 30, wherein the counterbore profile is recessed sufficiently to allow insertion into the stab body to provide protection for individual male pins and alleviate the potential for damage during handling.

32. The subsea blowout preventer stack control system of claim 10, wherein:

a. the hydraulic packer seals comprise a molded elastomer with an integral reinforcing ring element; and b. the hydraulic packer seals are retained in the male stab via tapered seal retainers, which are screw cut to match a female thread profile machined into the stab port interface.

33. A subsea blowout preventer stack, comprising:

a. a receptacle base, further comprising a wet make/break electrical connector;

b. a receiver receptacle disposed at least partially within the receptacle base, the receiver receptacle further comprising a hydraulic supply input port and an outlet port in fluid communication with a predetermined blowout preventer stack operator function port; and c. a functional control module adapted for use with a remotely operated vehicle (ROV), the functional control module further comprising:

i. an interface to a predetermined controllable function, the interface further comprising an interface to the receiver receptacle; and ii. a mateable top portion removably connectable to the receptacle base.

34. The subsea blowout preventer stack control system of claim 33, wherein:

a. the retrievable module further comprises an electronics module portion; and b. the electrical connector portion further comprises a predetermined number of conductors adapted to supply either power or a data signal to the electronics module portion of the retrievable module.

35. The subsea blowout preventer stack of claim 33, wherein:

a. the receiver receptacle further comprises a plurality of female receiver receptacles;

b. the functional control module further comprises a plurality of functional control modules; and c. a predetermined number of the plurality of functional control modules are arranged in a vertical array;

d. wherein each of the plurality of functional control modules interfaces with a respective female receiver receptacle.

36. The subsea blowout preventer stack control system of claim 35, wherein:

a. the receptable base is a static mounted female receiver receptacle base; and b. the "wet" make/break type electrical connector is adapted to functionally mate to a complementary connector integrated into a matching male stab portion of the retrievable functional control module.

37. The subsea blowout preventer stack control system of claim 36, wherein a corresponding male mandrel profile is machined into the static female receptacle base to accept a female portion complementary to the electrical connector portion.

38. The subsea blowout preventer stack control system of claim 37, wherein:

a. both the male mandrel in the female receptacle and a female counterbore in the male stab are machined with matching tapers, adapted to provide a centering function and positive alignment for the male/female connector halves when the stab enters the female receptacle; and b. the male mandrel in the female receptacle and the female counterbore in the male stab further assure correct hydraulic port, equal packer seal alignment, squeeze and loading when the male stab is mated in the female receptacle.

39. The subsea blowout preventer stack control system of claim 33, wherein the retrievable functional control module further comprises:

a. an atmosphere chamber adapted to maintain a predetermined pressure within the atmosphere chamber;

b. an electronics control Input/Output (I/O) module disposed within the atmosphere chamber;

c. a power supply disposed within the atmosphere chamber;

d. a pressure compensated housing disposed proximate the atmosphere chamber, the pressure compensated housing comprising a pressure compensating bladder disposed within the pressure compensated housing;

e. a pilot valve actuating solenoid disposed within the pressure compensated housing;

f. a hydraulic section disposed proximate to the pressure compensated housing;

g. a pilot valve disposed within the hydraulic section, the pilot valve in communication with and operated by the pilot valve actuating solenoid;

h. a function sub plate mounted valve (SPM), in communication with and piloted from the pilot valve; and i. a male stab assembly adapted to interface with a static mounted female receiver receptacle comprising a hydraulic port and a receiver wet make/break electrical connector portion, the male stab assembly further comprising:

i. an interface packer type hydraulic seal; and ii. a stab wet make/break connector half adapted to mate with the receiver wet make/break electrical connector portion and operatively in communication with the electronics control Input/Output (I/O) module.

40. A subsea blowout preventer stack system, comprising:

a. a riser adapter;

b. a multi-base riser connector in communication with the riser adapter and adapted to interface with a BOP stack;

c. a frusto-conical guidelineless re-entry funnel disposed about an outer surface of the multi-base riser connector;

d. a connector mandrel disposed within a predetermined portion of the guidelineless re-entry funnel and adapted to receive a multi-bore connector;

e. a receiver receptacle base adapted to receive a functional control module, the receiver receptacle base further comprising a "wet" make/break type electrical connector portion adapted to functionally mate to a complementary connector portion integrated into a matching male stab portion of the retrievable functional control module;

f. a plurality of female receiver receptacles disposed at least partially within the receiver receptacle base; and g. a plurality of retrievable functional control modules adapted to be maneuevered by a remotely operated vehicle (ROV) and further adapted to mate with a corresponding, predetermined one of the plurality of female receiver receptacles.

41. The subsea blowout preventer stack control system of claim 33 wherein the retrievable functional control module further comprises:

a. an atmosphere chamber adapted to maintain a predetermined pressure within the atmosphere chamber;

b. an electronics control Input/Output (I/O) module disposed within the atmosphere chamber;

c. a power supply disposed within the atmosphere chamber;

d. a pressure compensated housing disposed proximate the atmosphere chamber, the pressure compensated housing comprising a pressure compensating bladder disposed within the pressure compensated housing;

e. a pilot valve actuating solenoid disposed within the pressure compensated housing;

f. a hydraulic section disposed proximate to the pressure compensated housing;

g. a pilot valve disposed within the hydraulic section, the pilot valve in communication with and operated by the pilot valve actuating solenoid;

h. a function sub plate mounted valve (SPM), in communication with and piloted from the pilot valve; and i. a male stab assembly adapted to interface with a static mounted female receiver receptacle comprising a hydraulic port and a receiver wet make/break electrical connector portion, the male stab assembly further comprising:

i. an interface packer type hydraulic seal; and ii. a stab wet make/break connector half adapted to mate with the receiver wet make/break electrical connector portion and operatively in communication with the electronics control Input/Output (I/O) module.

42. The subsea blowout preventer stack control system of claim 33 wherein the module sections comprise a material which is suitable for long term immersion in salt water.

43. A method of constructing a subsea blowout preventer stack control system, comprising:

a. installing a subsea blowout preventer stack assembly subsea, the subsea blowout preventer stack assembly further comprising:

i. a female receiver receptacle, the female receiver receptacle further comprising:

(1) a hydraulic supply input port and an outlet port in fluid communication with a predetermined blowout preventer stack operator function port; and (2) a retrievable functional control module adapted to be maneuvered by a remotely operated vehicle (ROV) and further adapted to mate with the female receiver receptacle; and b. using an ROV to install a predetermined number of retrievable functional control modules into a predetermined corresponding number of female receiver receptacles.

44. The method of claim 36 further comprising:

a. using an atmosphere chamber portion of the retrievable functional control module to maintain a predetermined pressure within the atmosphere chamber; and b. using pressure compensating bladder disposed within a pressure compensated housing disposed proximate the atmosphere chamber to maintain pressure in the pressure compensated housing.

* * * * *